US007029338B1

(12) United States Patent
Orange et al.

(10) Patent No.: US 7,029,338 B1
(45) Date of Patent: Apr. 18, 2006

(54) RELEASABLE SIDE TERMINAL BATTERY CABLE CONNECTOR CLAMP

(76) Inventors: Charles M. Orange, 1882 Rosewood Ave., Nashville, TN (US) 37242; Steve Eller, 116 Happy Hollow Rd., Goodlettsville, TN (US) 37072

( * ) Notice: Subject to any disclaimer, the term of this patent is extended or adjusted under 35 U.S.C. 154(b) by 0 days.

(21) Appl. No.: 11/253,265

(22) Filed: Oct. 18, 2005

(51) Int. Cl.
*H01R 4/30* (2006.01)

(52) U.S. Cl. ..... 439/755
(58) Field of Classification Search ..... 439/755, 439/773, 766, 754
See application file for complete search history.

(56) References Cited

U.S. PATENT DOCUMENTS

| | | | | | |
|---|---|---|---|---|---|
| 3,605,065 | A | * | 9/1971 | Shannon | 439/504 |
| 4,390,232 | A | * | 6/1983 | Jamgotchian | 439/38 |
| 4,643,511 | A | * | 2/1987 | Gawlik et al. | 439/755 |
| 4,797,111 | A | * | 1/1989 | Ackmann | 439/755 |
| 4,936,799 | A | * | 6/1990 | Woodall | 439/755 |
| 5,024,619 | A | * | 6/1991 | Caraballo | 439/755 |
| 5,503,574 | A | * | 4/1996 | Louridas | 439/767 |
| 5,823,831 | A | * | 10/1998 | Bowater et al. | 439/773 |

* cited by examiner

*Primary Examiner*—Phuong Dinh
(74) *Attorney, Agent, or Firm*—Miller & Martin PLLC

(57) ABSTRACT

A side terminal battery cable converter clamp is provided with a clamp shaft having a distal male threaded end adapted to mate with a female threaded side terminal, said clamp shaft carrying a cam seat, a cammed handle with pin, and a locknut, wherein the cammed handle is operable to frictionally engage and release the distal male threaded shaft end and female threaded side terminal.

18 Claims, 4 Drawing Sheets

RELEASABLE SIDE TERMINAL BATTERY CABLE CONNECTOR CLAMP

The present invention relates generally to battery cable clamps and more particularly to a battery cable clamp adapted for use on a side-terminal that may be easily fastened and released by hand.

BACKGROUND ART

It will be appreciated by those skilled in the art that most automobiles, motorized vehicles, and inboard boats are started by battery power and that the standard modern battery is a 12-volt battery having metal top-post terminals for the opposing polarities of the battery to which the terminals of battery cables are attached. In addition to, or in lieu of, top-post battery terminals, some 12-volt battery batteries have side-terminals. Side-terminals are conductive plates with female threaded apertures. The standard battery cable terminal or connector for a side-terminal has one end connected to the battery cable and the opposite end is a plate with an aperture. A bolt is received through the aperture of the connector plate into the female threaded side-terminal, and the plate of the cable connector is bolted into contact with the conductive plate of the side-terminal to establish an electrical connection.

Due to cramped space in and around engine compartments where batteries are located, side-terminal connections may be necessary in some instances instead of top-post battery terminal connections. Many standard 12-volt batteries last for several years, especially when used sparingly, as in some recreational boats. During the course of the life of a battery, corrosion build up may occur and, indeed, side-terminal battery hardware is notorious for not wanting to turn. Accordingly, it is often necessary to tap the hardware lightly with a hammer or to try rotating the cable and connector plate slightly as a wrench is used to turn the bolt. Due to cramped conditions, it can be difficult to carry out these or other steps to loosen the side-terminal battery hardware. In other cases, the hardware may be sufficiently bound that it is necessary to cut the battery cable in order to remove the battery.

What is needed then, is a side-terminal battery connector that will overcome the problems of prior art devices.

SUMMARY OF THE INVENTION

Instead of the standard bolt which passes through a battery cable terminal plate aperture and is tightened into a female aperture of the side-terminal, the side-terminal battery cable connector clamp of the invention utilizes a bolt with a clamping handle. The bolt with clamping handle (in open position) can be inserted through the aperture of the cable connector plate and loosely screwed into the female threaded side-terminal. The clamping handle includes a boss or camming structure that increases the clamping pressure based upon the angular rotation of the handle with respect to the bolt. By moving the clamping handle to its closed position, the connector plate is firmly engaged against the side-terminal conductive plate. When it is desired to remove the battery cable, the handle can be released to its open position and a substantial decrease in the clamping pressure of the bolt against the female threads of the side-terminal results. The handle rotates loosely in axial directions and does not turn the bolt on which it is mounted. In this fashion the handle can be axially oriented in any direction required in a restricted space. Preferably, the components of the side-terminal connection clamp assembly are made of non-corrosive and in some cases non-metallic materials such as stainless steel and glass filled nylon. In this fashion, preferably the entire operation of the invention is possible without need for using any additional tools.

BRIEF DESCRIPTION OF THE DRAWINGS

These and other objects of the invention will be explained in greater detail in connection with the following drawings of the preferred embodiment of the invention.

DETAILED DESCRIPTION OF THE INVENTION

A description of the preferred embodiment of the present invention will be best understood by referring to FIGS. 1–7 of the accompanying drawings wherein like numerals refer to like parts.

Figure 1:
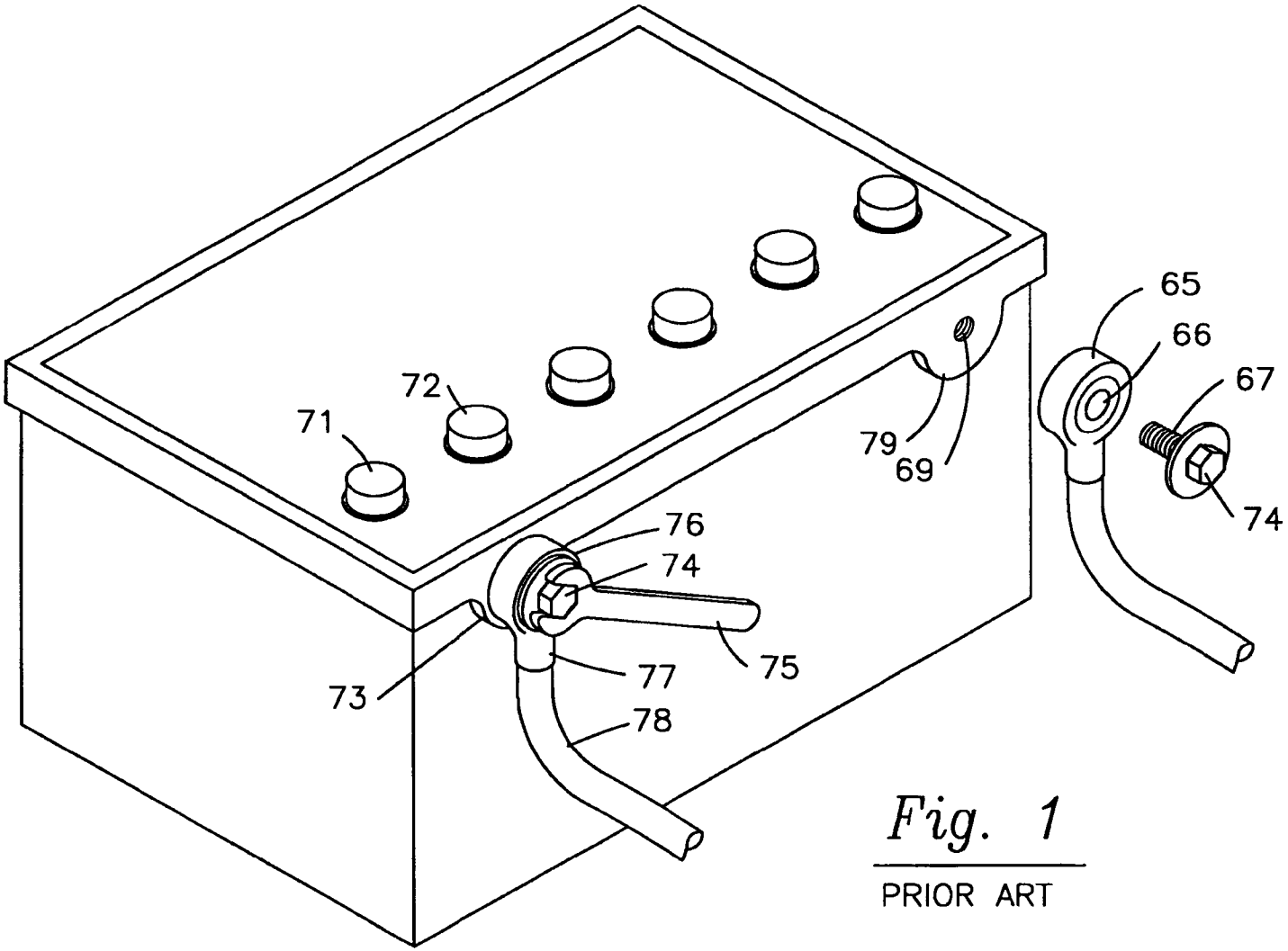
Fig. 1 PRIOR ART
FIG. 1 is an illustration of a representative battery with top-post terminals and side-terminals, and one battery cable attached.

Referring first to FIG. 1, a typical 12-volt battery 70 is shown with positive top-post terminal 71 and negative top-post terminal 72. Battery 70 also has a positive side-terminal 73 and corresponding negative side-terminal 79. Prior art battery cable terminals 76 have a generally circular distal end 65 or connector plate with aperture 66 to receive bolt 74. Bolt 74 has male threads 67 that engage with female threads in the apertures 69 of side-terminals 73, 79. Battery cable terminals or connectors 76 have a proximal end 77 that receives and is secured to battery cable 78. Bolts 74 are fastened and unfastened with a wrench to firmly contact battery cable terminals 76 to side-terminals 73, 79 and establish an electrical connection. In use, side-terminal battery hardware is notorious for not wanting to turn and it is often necessary to try to break corrosion or binding between bolt, battery cable terminal, and side-terminal by tapping the hardware with hammer or attempting to rotate battery cable connector 76 while a wrench 75 engaging bolt 74 is being turned. Due to the confined spaces in which batteries are often located, bringing the desired axial forces to play upon the side-terminal battery hardware is frequently difficult. The improved battery cable clamp 10 of the present invention takes the place of the traditional bolt 74, and may be fastened and released by hand.

Figure 2A:
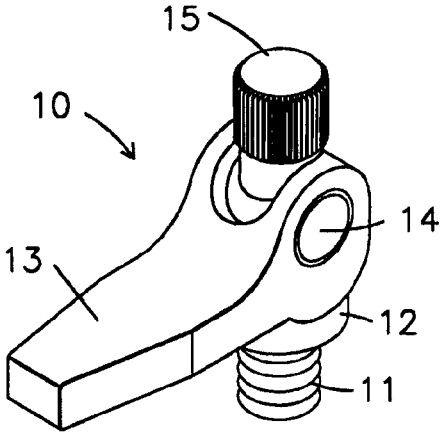
FIG. 2A is a perspective view of a side-terminal battery cable clamp according to the present invention.
Figure 2B:
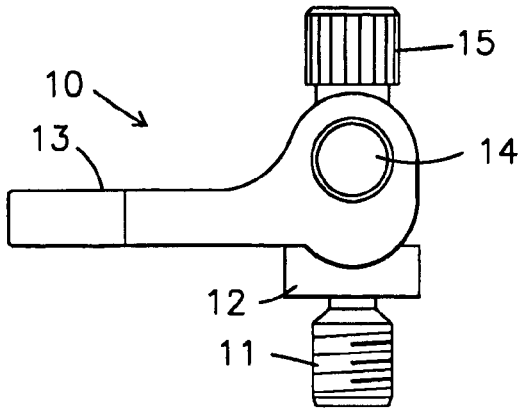
FIG. 2B is a side plan view of the clamp of FIG. 2A.

As shown in FIGS. 2A and 2B, the improved battery cable clamp 10 comprises a bolt or clamp shaft 11, a seat 12, a handle 13, a pin 14, and a cap or locknut 15.

Figure 3A:
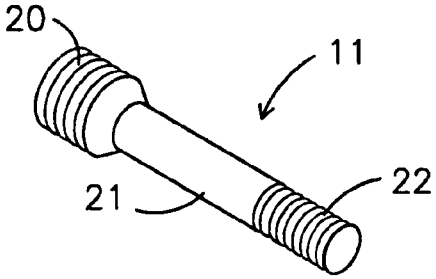
FIG. 3A is a perspective view of the bolt member of the clamp of FIG. 2A.
Figure 3B:
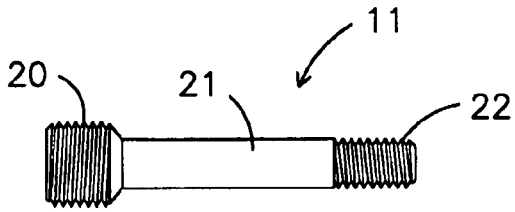
FIG. 3B is a side plan view of the bolt of FIG. 3A.
Figure 4A:
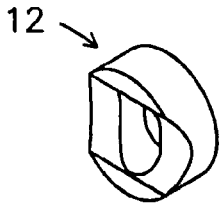
FIG. 4A is a perspective view of the seat of the clamp of FIG. 2.
Figure 4B:
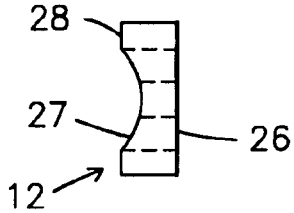
FIG. 4B is a side sectional view of the seat of FIG. 4A.
Figure 4C:
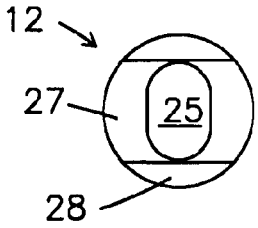
FIG. 4C is a top plan view of the seat of FIG. 4A.

FIGS. 3A and 3B show the clamp shaft 11 has a relatively large diameter distal end 20 with male threads 67 to be received within the female threads of the apertures 69 of side-terminals 73, 79 of battery 70, a central shaft section 21, and a proximal threaded end 22 of lesser diameter than distal end 20. Received over the proximal end 22 of clamp shaft 11 is seat 12. The proximal end 22 of clamp shaft 11 passes through opening 25 in seat 12 until seat 12 is retained by the larger distal end 20 of clamp shaft 11. The flat bottom surface 26 of seat 12 abuts distal end 20 of clamp shaft 11 and the central section 21 of clamp shaft 11 passes through aperture 25, said aperture 25 preferably having an ovular configuration. The ovular configuration allows the seat 12 to work with handles having unusually exaggerated cam sections. The top surface of seat 12 has a concave section 27, or cam surface, centrally located wherein the concave surface extends axially in a direction perpendicular to the major axis of the ovular aperture 25. At either end of the concave surface in the direction of the major axis of aperture 25 are raised end sections 28.

Pin 14 is positioned in lateral opening 32 of handle 13. Handle 13 and pin 14 are threaded with proximal end 22 of clamp shaft 11 passing through aperture 40 of pin 14. The base portion 30 of handle 13 rests in the concave section 27 of seat 12 and aperture 40 of pin 14 is positioned on the central section 21 of clamp shaft 11. Handle 13 has handle portion 31 and base portion 30. In addition to lateral opening 32 adapted to receive pin 14, base portion 30 has a bottom opening 33 that is generally oriented against cam seat 12, and a top opening 34. The central portion 21 of clamp shaft 11 passes through top and bottom openings 33 34. Top and bottom openings 33, 34 are generally ovular with front and back edges acting as stops to permit only limited angular rotation of handle 13 with respect to clamp shaft 11. Preferably about 45° of angular rotation is allowed. Furthermore, the orientation of lateral opening 32 within base 30 of handle 13 is off-center so that when the handle section is oriented approximately perpendicular to clamp shaft 11, the thickest portion or cam section 35 of the base is interposed between pin 14 and cam seat 12. Preferably the cam section 35 is off center an exaggerated amount of at least 0.15 inches and preferably 0.16 inches. When the handle section 31 is angularly rotated away from its position normal to the clamp shaft 11, a thinner section of the base 30 is interposed between pin 14 and cam seat 12. Cam section 35 is formed from wings 38 and 39 of base 30 that are on either side of bottom opening 33. Similar, but thinner wings, 36, 37 are on either side of top opening 34, and permit the proximal end 22 of clamp shaft 11 to protrude.

As previously described, the pin 14 is received over proximal end 22 of clamp shaft 11 and is positioned within lateral opening 32 of handle 13. The pin 14 has a central aperture 40 to allow the proximal end 22 of clamp shaft 11 to pass through, and pin 14 is oriented with recess 41 upwardly facing.

Finally, the components of the side-terminal battery cable clamp 10 are held in place by the attachment of cap or locknut 15 which has a proximal knurled portion 46 and a narrower distal portion 47. The end cap 15 also has a threaded aperture 48 which is screwed onto the male threads of proximal end 22 of clamp shaft 11. The distal portion 47 abuts the upward recess 41 of pin 14.

When the side-terminal battery cable clamp 10 is fully assembled, the handle portion 31 is rotated out of normal orientation from clamp shaft 11 so that a relatively thin portion of base 30 is interposed between seat 12 and pin 14. Then the male threaded distal end 20 of clamp shaft 11 is passed through aperture 66 of battery cable terminal plate 65 and then threaded into the female threads of the aperture 69 of side-terminal 73 of battery 70. The battery cable clamp 10 is hand tightened by turning knurled portion 46 of locknut 15, which causes clamp shaft 11 and its threaded distal end 20 to turn. After being turned sufficiently to engage male threads of distal end 20 with female threads of aperture 69, handle portion 31 is depressed to a position normal to clamp shaft 11 and substantially parallel with the side surface of battery 70. This has the effect of interposing thicker cam section 35 between seat section 12 and pin 14, which applies pressure between male threads of distal clamp section 20 and the threads of side-terminal opening 69 on battery 70. This securely presses the battery cable terminal connector 76 against the battery side-terminal 73 to ensure a good electrical connection. The pressure exerted between male and female threads also holds clamp 10 securely in place.

When it is desired to remove the battery cable terminal 76 from the side-terminal 73, 79, the handle section 31 of clamp 10 is rotated out of normal which removes the cam section 35 from its position between pin 14 and seat 12, thereby relieving pressure between male threads of distal clamp shaft 20 and female threads of side-terminal opening 69. This permits the battery cable clamp connector to be removed by hand by rotating knurled surface 46 of end cap 15 to disengage the threaded bolt end 20 of side-terminal aperture 69, thereby permitting the clamp 10 to be removed from the side-terminal 73 and the battery cable terminal plate 76 to be disengaged from side-terminal 73, 79. Preferably, the handle 13, seat 12, and end cap 15 will be made of glass filled nylon, and the end cap 15 may have a stainless steel insert within aperture 48 for added strength. The end cap 15 may also be permanently fastened, as by adhesive, to the distal end 22 of clamp shaft 11 once the clamp 10 is assembled. The pin 14 and clamp shaft 11 are both preferably made of stainless steel and thereby all of the components are resistant to rust and corrosion.

It has been noted that bottom aperture 33 and upper aperture 34 of handle 13 are ovular or elongated in nature, this permits the angular rotation of handle 13 with respect to shaft 11 about pin 14. Preferably, about 45° of rotation is allowed by these openings, which is sufficient to insert or remove the cam section 35 from between the pin 14 and seat 12. If the handle section 31 were raised more than 45° from normal with the clamp shaft, it would require additional clearance between the side of battery 70 and its compartment. It is to be noted that the handle section 13 is held to the clamp shaft 11 by pin 14. Pin 14 and therefore handle section 13 rotate freely in the axial direction about lock shaft 11. This permits the handle section 31 to be oriented in any direction needed to fit within the space of the battery compartment.

Figure 5A:
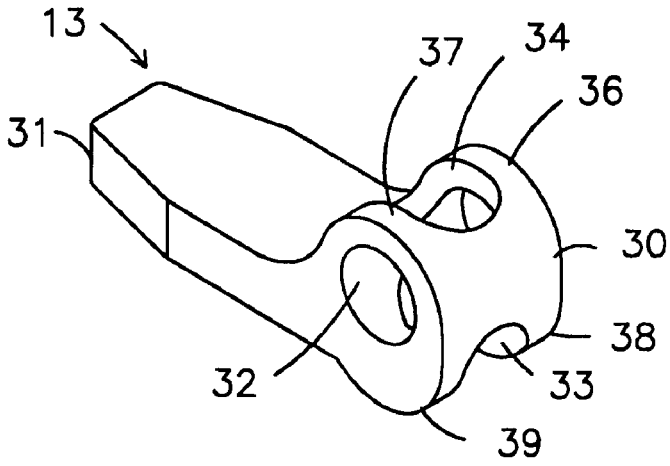
FIG. 5A is a perspective view of the handle of the clamp of FIG. 2.
Figure 5C:
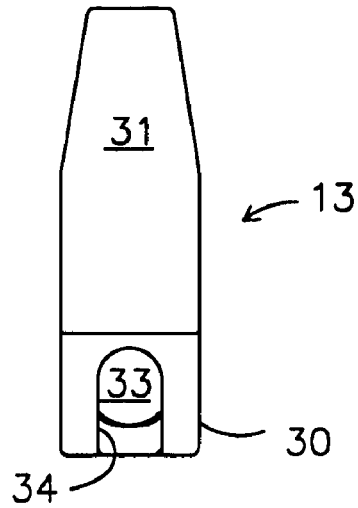
FIG. 5C is a bottom plan view of the handle of FIG. 5A.
Figure 5B:
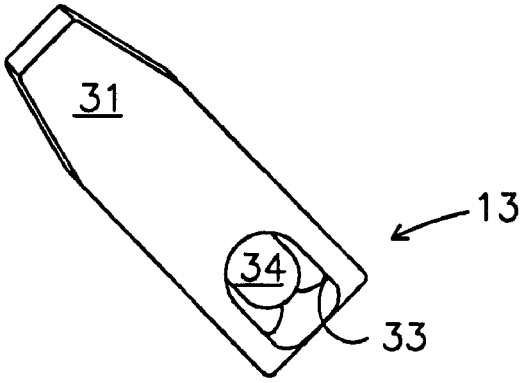
FIG. 5B is a top plan view of the handle of FIG. 5A.
Figure 5D:
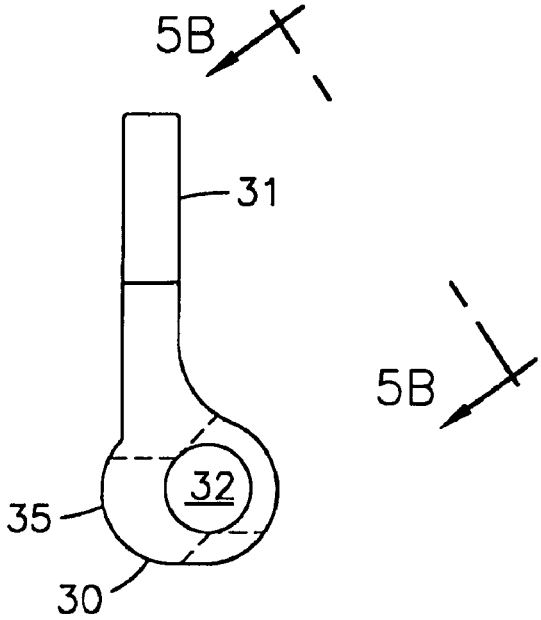
FIG. 5D is a side plan view of the handle of FIG. 5A.
Figure 7A:
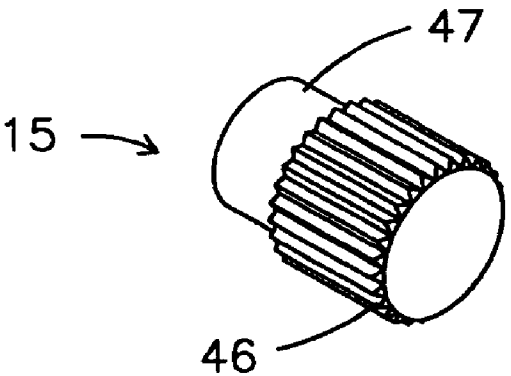
FIG. 7A is a perspective view of the cap of the clamp of FIG. 2.
Figure 7B:
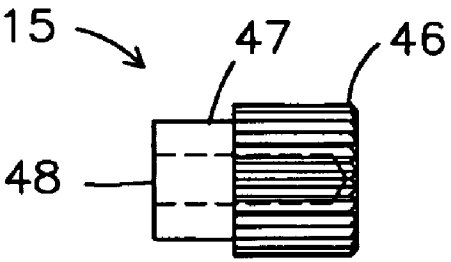
FIG. 7B is a side plan view of the cap of FIG. 7A.
Figure 6A:
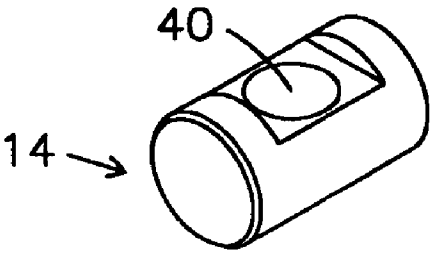
FIG. 6A is a perspective view of the pin of the clamp of FIG. 2.
Figure 6B:
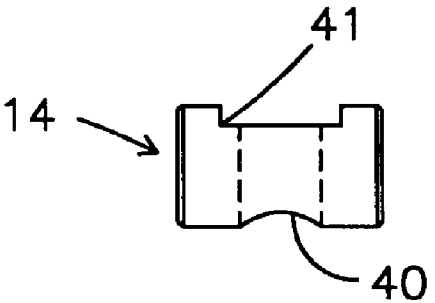
FIG. 6B is a side sectional view of the pin of FIG. 6A.

It may also be noted in FIG. 5B that the handle section 31 is offset from the axial center pin 14 to the side of cam 35 on the base 30 of handle 13 by about 0.12 to 0.14 inches. In this fashion, even when the handle section is rotated angularly with respect to clamp shaft 11 by about 45°, due to the offset of handle section 31 and the movement of handle 13 and cam seat 12 with respect to lock shaft 11 permitted by ovular opening 25, the knurled portion 46 of locking cap 15 is still accessible through upper aperture 34 of handle 13. This permits the side-terminal battery cable clamp 10 to be threaded or unthreaded from the female threads of the opening of side-terminal 73, 79 by manually turning the knurled portion 46 of the locknut 15 regardless of the axial or angular position of the handle section 31.

Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. A battery cable terminal connector comprising (a) a shaft having a threaded distal end, a central portion and a threaded proximal end of relatively small diameter than the distal end;

(b) a cam seat having an opening received on the central portion of the shaft and a bottom surface facing the threaded distal end of the shaft and a top cam surface;

(c) a pin being received within a lateral aperture of a handle, said pin having an aperture received over the central portion of the shaft;

(d) said handle having a base section with both a cam section and the lateral aperture, and a handle section; and (e) a locknut mounted to the proximal end of the shaft and thereby restraining the pin and cam seat on said shaft.

2. The battery cable terminal connector of claim 1 wherein the aperture of the cam seat is ovular in shape.

3. The battery cable terminal connector of claim 1 wherein the cam section of the handle is exaggerated.

4. The battery cable terminal connector of claim 1 wherein the handle section of the handle is offset from the center of the lateral pin receiving opening in the direction of the cam section of the base of the handle.

5. The battery cable terminal connector of claim 1 wherein the base portion of the handle has a bottom opening and a top opening through which the shaft passes.

6. The battery cable terminal connector of claim 5 wherein the top and bottom openings are generally ovular with front and back edges acting as stops to permit limited angular rotation of the handle with respect to the shaft.

7. The battery cable terminal connector of claim 1 wherein the handle is angularly rotatable with respect to the clamp shaft through an arc of approximately 45 degrees.

8. The battery cable terminal connector of claim 7 wherein the locknut is accessible for manual rotation, and corresponding rotation of the shaft, throughout the range of angular rotation of the handle.

9. The battery cable terminal connector of claim 7 wherein when the handle section is oriented normal to the longitudinal axis of the clamp shaft the cam section of the base is interposed between the pin and cam seat.

10. The battery cable terminal connector of claim 7 wherein the locknut has a knurled surface.

11. The battery cable terminal connector of claim 1 wherein the pin and handle are freely axially rotatable with respect to the shaft.

12. The battery cable terminal connector of claim 1 wherein the pin has a recess and a distal portion of the locknut abuts said recess.

13. The battery cable terminal connector of claim 1 wherein the shaft, cam seat, pin, handle and locknut are fabricated from non-corrosive materials.

14. A method of securing a battery cable to a side-terminal utilizing a battery cable terminal connector having a shaft with a threaded distal end, a central portion and a threaded proximal end of relatively small diameter than the distal end, a cam seat having an opening received on the central portion of the shaft and a bottom surface facing the threaded distal end of the shaft and a top cam surface, a pin being received within a lateral aperture of a handle said pin having an aperture received over the central portion of the shaft, comprising the steps of:

(a) passing the threaded distal end through a battery cable terminal aperture and engaging the threaded distal end of the shaft with a threaded aperture of the side terminal while the cam section is not interposed between the pin and cam seat;

(b) turning the locknut and thereby the shaft to engage at least several revolutions of threads;

(c) angularly rotating the handle section with respect to the shaft to interpose the cam section between the pin and cam seat and thereby secure the battery cable terminal against the battery side terminal.

15. The method of claim 14 wherein the handle section is moved through an arc of approximately 45 degrees with respect to the shaft in order to interpose the cam section between the pin and cam seat.

16. The method of claim 14 wherein the handle and pin are axially rotated with respect to the shaft before the handle section is rotated angularly to interpose the connectors between the pin and cam seat.

17. A method of removing a battery cable terminal that is secured to a battery side-terminal with a threaded aperture by a battery cable terminal connector of the type having a shaft with a threaded distal end, a central portion and a threaded proximal end of relatively small diameter than the distal end, a central portion and a threaded proximal end of relatively small diameter than the distal end, a cam seat having an opening received on the central portion of the shaft and a bottom surface facing the threaded distal end of the shaft and a top cam surface, a pin being received within a lateral aperture of a handle said pin having an aperture received over the central portion of the shaft, comprising the steps of:

(a) rotating the handle section angularly with respect to the shaft to remove the cam section from between the pin and cam seat;

(b) turning the locknut and attached shaft to unthread the distal end of the shaft from the side-terminal aperture removing the distal end of the shaft from the battery cable terminal aperture; and (c) removing the battery cable terminal from the battery side-terminal.

18. The method of claim 17 wherein the handle section is moved through an arc of about 45° with respect to the shaft in order to remove the cam section from between the pin and the cam seat.

* * * * *